US005386282A

United States Patent [19]

Palmer et al.

[11] Patent Number: 5,386,282

[45] Date of Patent: Jan. 31, 1995

[54] BLADE CONTROLLER ASSEMBLY WITH MODIFIED CAM

[75] Inventors: John M. Palmer; Kris J. Walker, both of Webster; Dennis P. Eidem, Fairport; Bernard J. Dunham, Walworth, all of N.Y.

[73] Assignee: Xerox Corporation, Stamford, Conn.

[21] Appl. No.: 152,356

[22] Filed: Nov. 15, 1993

[51] Int. Cl.[6] ..... G03G 21/00

[52] U.S. Cl. ..... 355/299; 15/256.51

[58] Field of Search ..... 355/299, 296; 15/356.51

[56] References Cited

U.S. PATENT DOCUMENTS

| | | | |
|---|---|---|---|
| 3,552,850 | 1/1971 | Royka et al. | 355/299 |
| 4,619,523 | 10/1986 | Maeda et al. | 355/299 |
| 4,639,122 | 1/1987 | Pease | 355/15 |
| 4,702,591 | 10/1987 | Tsuda et al. | 355/299 |
| 4,796,057 | 1/1989 | Howard et al. | 355/15 |
| 4,821,974 | 4/1989 | Poehlin | 242/68 |
| 4,996,556 | 2/1991 | Gray, Jr. | 355/50 |
| 5,040,777 | 8/1991 | Bell et al. | 271/3 |
| 5,107,304 | 4/1992 | Haneda et al. | 355/299 X |
| 5,208,639 | 5/1993 | Thayer et al. | 355/299 |
| 5,237,378 | 8/1993 | McEwen | 355/309 |

*Primary Examiner*—A. T. Grimley
*Assistant Examiner*—Nestor R. Ramirez
*Attorney, Agent, or Firm*—T. L. Fair

[57] ABSTRACT

An apparatus for retracting and engaging the cleaning blade from the imaging surface and preventing copy reprint. At least one of two momentary switches are depressed by one of at least two lobes on a motorized cam. When the copying machine is in a standby condition, a computer controlled signal energizes the cam motor to advance the cam until the appropriate switch is depressed by the cam lobe.

8 Claims, 7 Drawing Sheets

BLADE CONTROLLER ASSEMBLY WITH MODIFIED CAM

BACKGROUND OF THE INVENTION

This invention relates generally to an electrophotographic copying device, and more particularly, a blade controller assembly used therein to remove particles adhering to the imaging surface (i.e. photoreceptor or photoconductor).

In an electrophotographic application such as xerography, a charge retentive surface is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and copying/printing applications from electronically generated or stored originals, where a charge surface may be imagewise discharged in a variety of ways. Ion projection devices, where a charge is imagewise deposited on a charge retentive substrate, operate similarly.

In a reproduction process of the type as described above, it is inevitable that some residual toner will remain on the photoconductive surface after the toner image has been transferred to the sheet of support material (e.g. paper). It has been found that with such a process that the forces holding some of the toner particles to the imaging surface are stronger than the transfer forces and, therefore, some of the particles remain on the surface after transfer of the toner image. In addition to the residual toner, other particles, such as paper debris (i.e. Kaolin, fibers, clay), additives and plastic, are left behind on the surface after image transfer. (Hereinafter, the term "residual particles" encompasses residual toner and other residual debris remaining after image transfer.) The residual particles adhere firmly to the surface and must be removed prior to the next copying cycle to avoid its interfering with recording a new latent image thereon.

Various methods and apparatus may be used for removing residual particles from the photoconductive imaging surface. One such method and/or apparatus is the use of a cleaning blade. Blade cleaning involves a blade, normally made of a rubberlike material (e.g. polyurethane) which is dragged or wiped across the surface to remove the residual particles from the surface. Blade cleaning is a highly desirable method, compared to other methods (e.g. brushes and webs), for removing residual particles due to its simple, inexpensive structure. To assure reliable and effective cleaning of the imaging surface, a certain amount of force must of necessity be applied to the blade to maintain the cleaning edge against the imaging surface with sufficient pressure to avoid allowing any particulate material on the imaging surface to slip past.

However, during periods when the machine is not in use and the imaging surface is stationary, the sustained pressure of the cleaning blade against a single point on the imaging surface can cause cold flow or crystallization of the imaging surface. When this happens, replacement or refurbishing of the imaging surface is usually necessary.

Many copying machines currently use a solenoid to engage and retract the cleaner blade from the photoreceptor. The solenoid to weight gap [i.e. the distance between the weight and the end of the solenoid plunger which is measured/adjusted when the solenoid is energized (The gap is present to allow the solenoid to achieve the momentum to overcome the spring force of the solenoid.)] adjustment is a set up procedure that needs to be performed in order for the solenoid to energize and allow the cleaner blade to come in contact with the photoreceptor. Data has been compiled from field reports on machines that utilize a solenoid and the frequency at which this adjustment must be made.

Another problem encountered is that the cleaning edge of the blade retains a certain amount of toner and/or residual particles after cleaning the imaging surface. When a blade containing these particles is reengaged with the imaging surface after retraction, these particles often fall onto the imaging surface due to the amount of force used to put the blade edge back in contact with the imaging surface. As a result, the photoreceptor transfers this defect onto the copy called a first copy reprint (FCR).

The following disclosures may be relevant to various aspects of the present invention and may be briefly summarized as follows:

U.S. Pat. No. 4,796,057 to Howard et al. discloses an apparatus for separating residual toner material from the surface of a reusable photoreceptor in a reproducing machine having a cleaner blade assembly. The cleaner blade assembly is movable between two positions. In a first position the blade operatively engages the photoreceptor to clean off the residual toner material which is then collected in a generally enclosed chamber below. In the second position the blade assembly is spaced apart form the photoreceptor but covers the entrance to the chamber forming a sealed enclosure for the contents. Thus, the toner collecting chamber is sealed by the cleaner blade alone without relying on the photoreceptor to perform a sealing function.

U.S. Pat. No. 4,639,122 to Pease discloses disengaging the cleaning blade from the photoreceptor of a reproduction machine to avoid cold set and damage to the photoreceptor during prolonged machine shutdowns. A bi-metal coil spring is positioned inside the fusing roll to sense fuser temperatures. A linkage couples the spring to the cleaning blade so that when fuser temperatures fall below a preset operating temperature, the spring relaxes permitting a weighted member to retract and disengage the blade from the photoreceptor.

SUMMARY OF INVENTION

Briefly stated, and in accordance with one aspect of the present invention, there is provided an apparatus for cleaning particles from a surface, comprising: means for cleaning particles from the surface; a controller assembly for moving the cleaning means between a first position and a second position, the controller assembly having a cam and the cam having a first end and a second end opposite one another; and a weight adapter engaging the first end of the cam to move the cleaning means between the first position and the second position.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 10:
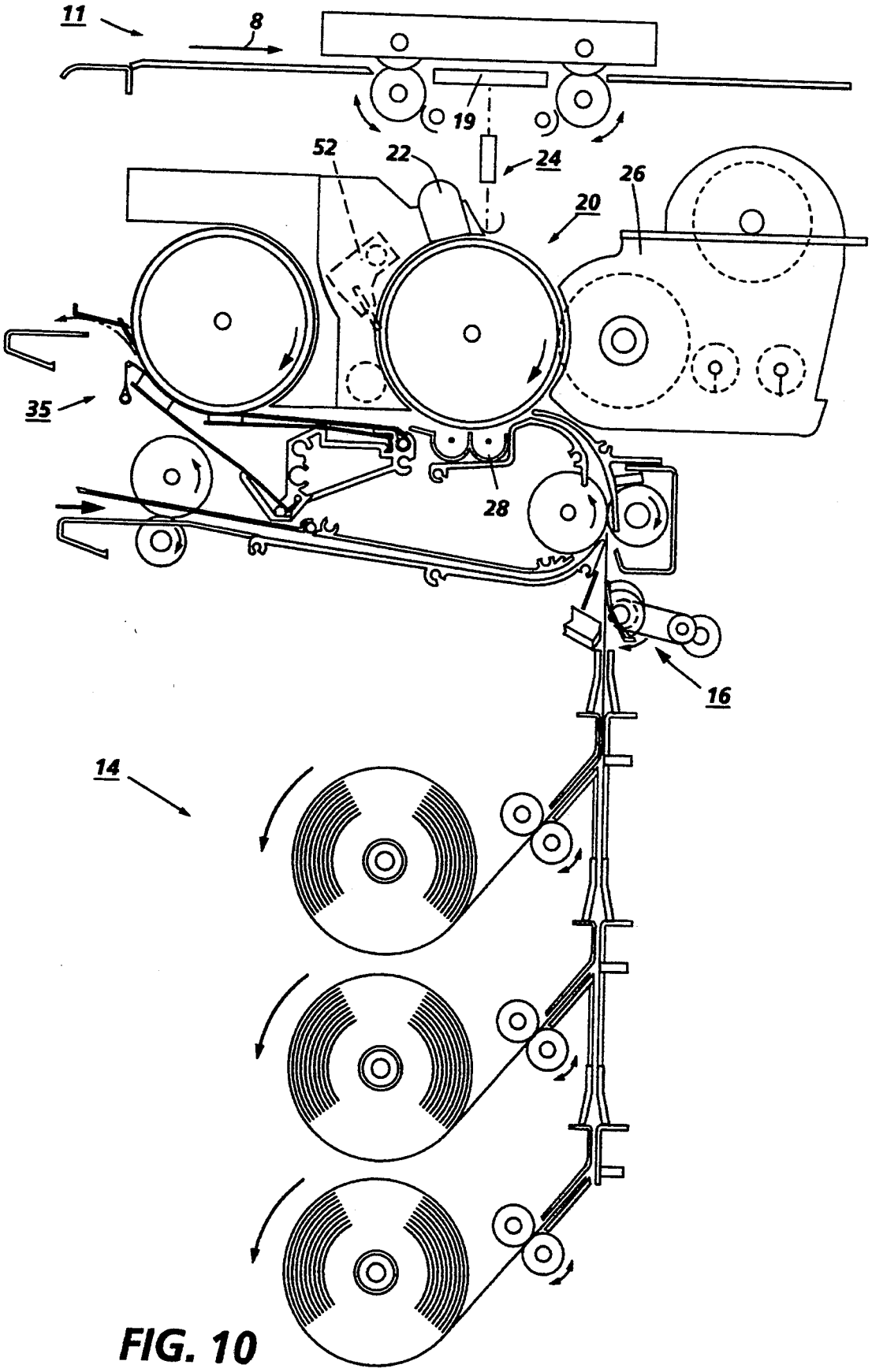
FIG. 10 is a schematic, elevational view of a copying machine.

Referring now to the drawings in detail wherein like numbers represent like elements. FIG. 10 shows an elevational view of the copier machine 11. Machine 11 includes an electrostatic drum 20 with processing stations arranged around its periphery, which carry out the operational steps of the copying process. These stations include charging station 22, exposure station 24, developing station 26, transfer station 28 (where a developed image is transferred to a sheet) and fusing station 35. The cut sheet is then forwarded out of the machine. Documents fed along the platen 19 in the direction of arrow 8 are imaged onto the surface of drum 20, at exposure station 24. The operations of the stations are described, for example, in U.S. Pat. Nos. 4,821,974; 4,996,556; and 5,040,777, whose contents are incorporated herein by reference. The media roll assembly 14 and the cutter assembly 16 are described in U.S. Pat. No. 5,237,378, whose content is incorporated herein by reference.

Figure 1:
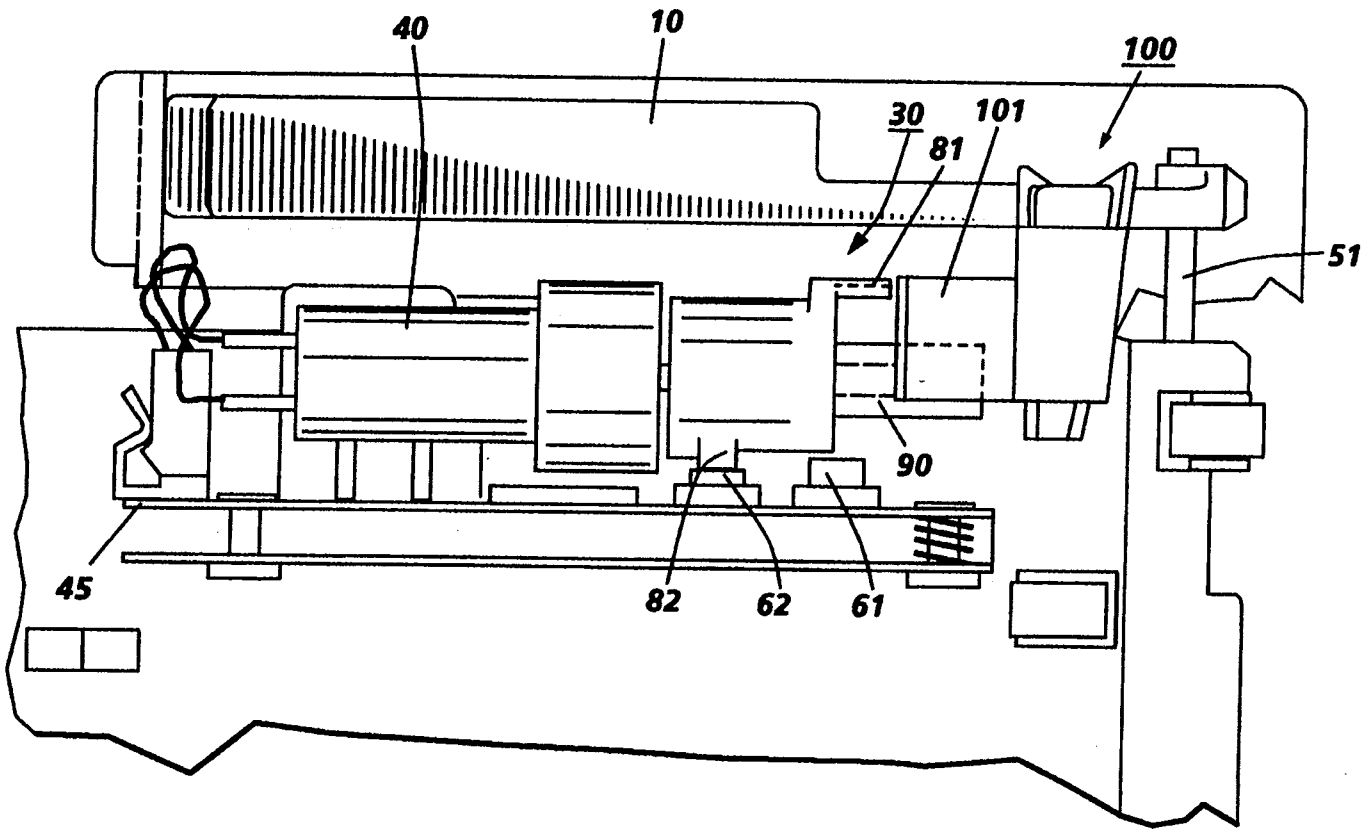
FIG. 1 is a plan view of a module containing the preferred embodiment of the present invention.

Referring now to FIG. 1 which shows a top (i.e. plan) view of a xerographic module incorporating the preferred embodiment of the present invention. The blade controller assembly enables the engagement or retracting operations of the cleaner blade system. The blade controller assembly consists of a DC motor 40, which drives a cam 30. The cam 30 has two actuating tabs or lobes 81, 82 which depress momentary switches 61, 62 located on a circuit board 45 to engage or retract the cleaning blade system. To prolong the life of the blade 50 (shown in FIG. 3) for cleaning, the blade 50 (see FIG. 3) is retracted from the imaging surface when the copier is not in use. (This figure shows the blade's shaft 51). This prevents or reduces deformation and damage to the blade and the imaging surface. Furthermore, the use of the cam 30 eliminates the adjustment or setup required by a solenoid controlled retraction and engagement of the blade, thus, improving field reliability. The blade 50 (shown in FIG. 3) is reengaged with the imaging surface when the copier is in use.

Upon initial startup of the copying operation, a low potential electrical signal generated by computer energizes the motor 40 that advances (e.g. rotates) the cam 30 until a switch 61 (i.e. thereby engaging the cleaning blade 50 with the photoreceptor) is depressed which allows the cleaning blade 50 to remove excess toner from the photoreceptor. Once the copying machine cycles down into a standby condition the electrical signal goes low and the motor 40 energizes and advances the cam 30 until switch 62 is depressed which retracts the cleaning blade 50 from the photoreceptor. A brake circuit (not shown) reduces the motor shaft coasting after either momentary switch 61, 62 is depressed.

With continued reference to FIG. 1, switch 62 is engaged by a lobe 82 thus, stopping the rotation of cam 30 into a position such that the protrusion 90 is in contact with the lip 101 of the weight adapter 100. When the blade 50 is engaged with the photoreceptor, the motorized cam 30 has rotated the lobe 81 into an engagement position with switch 61. This position places the protrusion 90 out of contact with the lip 101 of the weight adapter 100 lowering the weight 10, and allowing the gravitational force of the weight 10 to bring the blade into contact with the photoreceptor. The arcuate protrusion 90 is contoured in a manner where one face is convex and the opposite face is concaved. When the convex face contacts the bottom side of the adapter lip 101, it raises the weight 10 upward as the cam rotates the protrusion 90 until the apex of the convex face and the bottom side of the adapter lip 101 are in contact. The weight adapter 100 is attached by a clamping mechanism (i.e. clips 102, see FIG. 6) to a weight 10 which is coupled to the cleaning blade shaft 51 which in turn, is coupled to the cleaning blade. The weight 10 creates the force needed to prevent blade bounce and provides adequate pressure between the blade and photoreceptor (not shown) for cleaning. Whether the cleaner blade is engaged with the photoreceptor, where the concave face of the protrusion 90 faces the underside of the weight adapter lip 101 and the lip 101 is out of contact with the protrusion 90; or, the cleaner blade is disengaged from the photoreceptor, where the convex face of the protrusion 90 contacts the bottom surface of the weight adapter lip 101; the weight adapter lip 101, in either case, rides along the contoured shape of the cam 30 as the cam rotates.

Basically, the rotation of the cam 30 and the contour of the protrusion 90 allow the weight 10 to be raised and lowered gently as the blade controller assembly (e.g. a printed wiring board assembly (PWBA) 45) receives a signal from a master controller to engage or disengage the blade with the photoreceptor. When the weight 10 is raised, the blade 50 is disengaged or retracted from the photoreceptor. And when the weight 10 is lowered from the raised position, the blade 50 is urged into engagement with the photoreceptor.

The present invention alleviates the problem of "first copy reprint". First copy reprint (FCR) is generated by excess toner building up on the back side of the cleaning blade 50. This is achieved after a copy has been made and the machine motor drives have stopped (i.e. copying operation has stopped). The cleaning blade 50 is disengaged from the imaging surface and an excessive amount of toner has been built up on the back side of the cleaning blade. First copy reprint occurs when the blade is forcibly released (i.e. slammed) against the photoreceptor when the weight adaptor falls sharply off the high point of the cam. This "slamming" affect causes the excess toner, on the back side of the blade to fall onto the photoreceptor (i.e. imaging surface) and develop as a solid line across the first copy. In the present invention, the cain's profile has been reshaped to allow a gradual engagement of the cleaning blade to the imaging surface. This reduces the amount of excess toner that will be applied to the imaging surface upon initial start up of the machine.

The blade controller assembly's cam 30 is in direct contact with the weight adapter 10, which eliminates the need for a measurement procedure to set the gap dimension. The reason for this "elimination" is that there is more latitude using the cam then the solenoid configuration.

Figure 2:
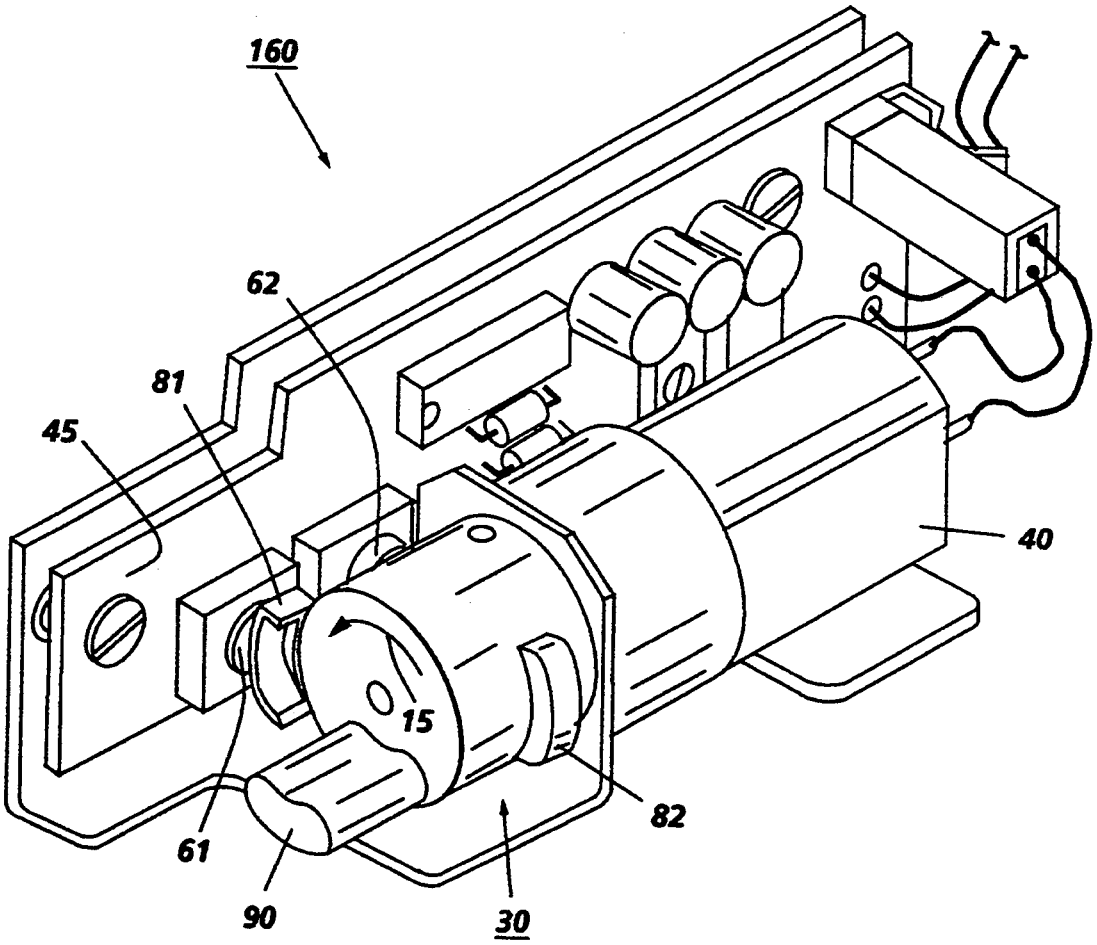
FIG. 2 is a perspective view of the blade controller assembly with the preferred embodiment.

Reference is now made to FIG. 2, which shows a perspective view of the blade controller assembly 160. The blade controller assembly printed wiring board 45 controls the DC motor 40. The momentary switches 61, 62 are located on the printed wiring board assembly (PWBA). The blade controller uses the lobes 81, 82 on the cam 30 to depress the switches 61, 62 for engagement and retraction of the blade to and from the imaging surface. The cam 30 rotates in a counterclockwise direction indicated by arrow 15.

With continued reference to FIG. 2, the rotation of the cam 30 places the lobes 81, 82 in contact with momentary switches that assist in raising or lowering the weight to engage or disengage the blade from the photoreceptor. One lobe 81 is rotated into contact with a switch 61 when the blade is engaged with the photoreceptor. The depression of switch 61 by the lobe 81, simultaneously engages the blade with the photoreceptor. The blade is likewise disengaged upon the rotation of the cam 30 that depresses the switch 62 by the lobe 82.

Figure 3:
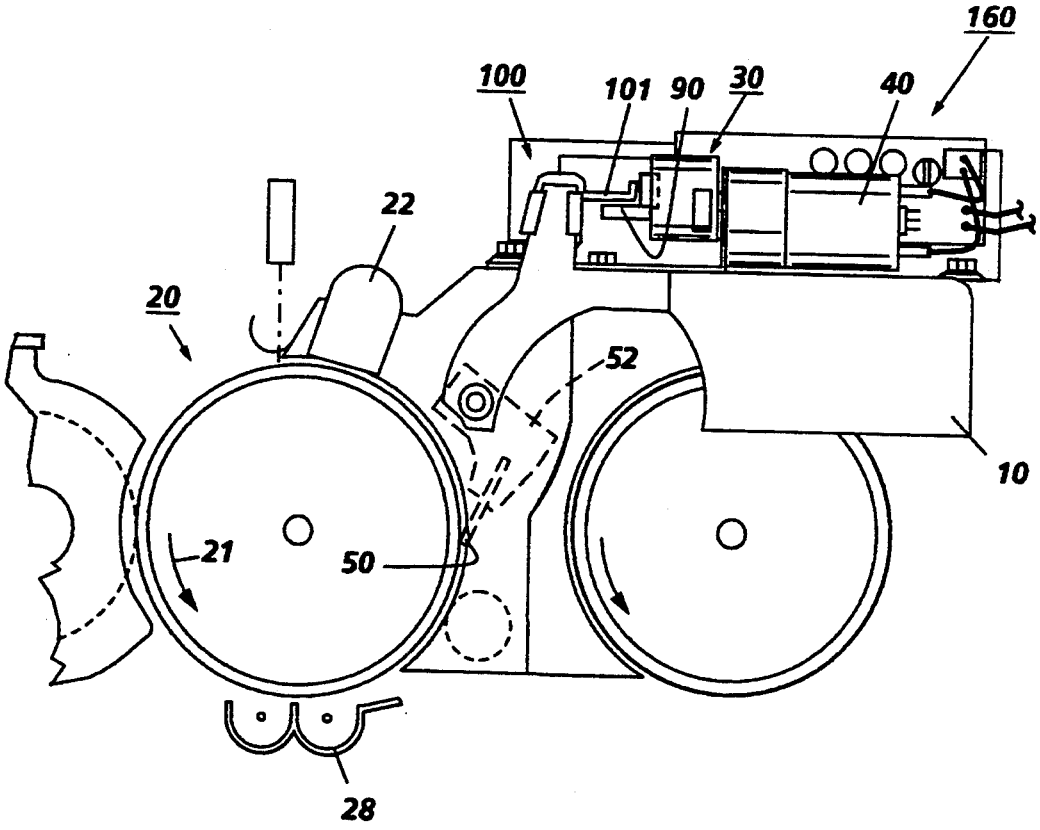
FIG. 3 is an elevational view of the preferred embodiment of the blade controller assembly in the machine.

Reference is now made to FIG. 3, which shows an elevational view of the copying machine from the left side. The blade holder 52 and the blade 50 are shown in phantom lines. This view more clearly shows the interaction of how the blade controller assembly 160, the weight adapter 100, the weight 10 and the blade 50 are interrelated to allow the blade 50 to contact the photoreceptor 20, rotating in the direction of arrow 21. When the lip 101 of the weight adapter 100 is not in contact with the protrusion 90 of the cam 30 (as shown), the weight 10 is at it's home position and the cleaning blade 50 is engaged with the photoreceptor 20.

Figure 4:
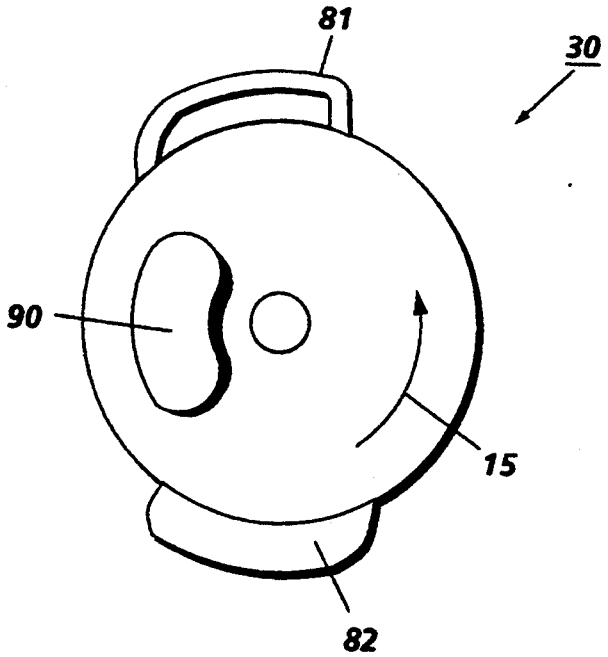
FIG. 4 is a plan view of the preferred embodiment of the cam of the present invention.

Reference is now made to FIG. 4 which shows an plan view of the preferred embodiment of the cam 30. The lobes 81, 82 contact the momentary switches on the PWBA at different times to disengage or engage the blade with the photoreceptor as the cam rotates in the counterclockwise direction shown by arrow 15.

Figure 5:
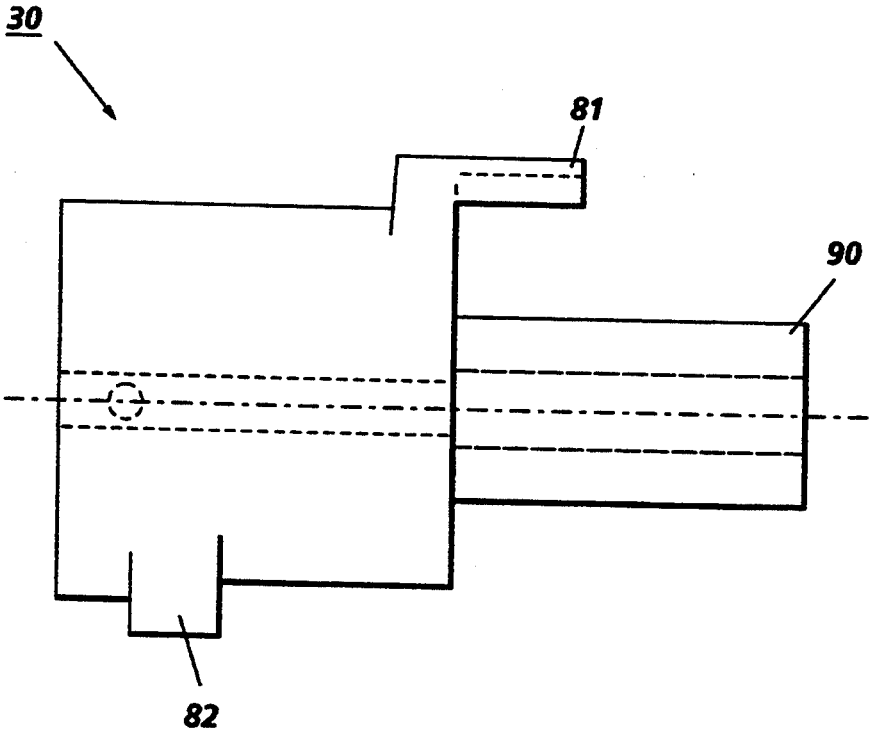
FIG. 5 is an elevational view of the preferred embodiment of the cam.
Figure 6:
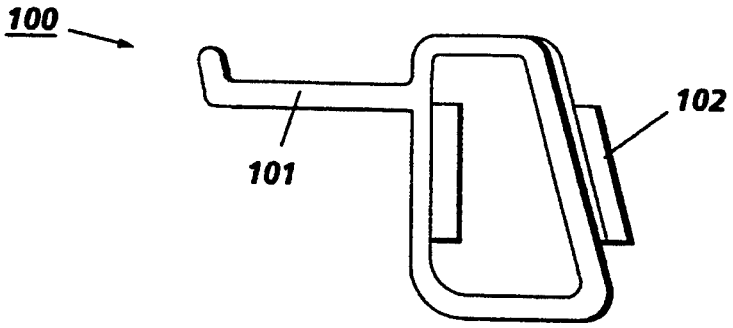
FIG. 6 is an elevational view of the preferred embodiment of the weight adapter.

Reference is now made to FIGS. 5 and 6, which show an elevational view of the preferred embodiment of the cam 30 and an elevational view of the preferred embodiment of the weight adapter 100, respectively. The cam protrusion 90 (see FIG. 5) contacts the weight adapter 100 (see FIG. 6), as described above, when the convex face of the protrusion 90 is rotated into contact with the bottom side of the lip 101. The lip 101 of the weight adapter is raised in an upward motion as the convex face of the protrusion 90 rotates until the apex of the convex portion is in contact with the bottom surface of the weight adapter lip 101 and the bottom surface rides along the surface of the protrusion 90. This action due to the contact of the lip 101 and the cam protrusion 90, disengages the cleaning blade from the photoreceptor. To engage the cleaning blade another signal is received from the master controller, by the blade controller, to rotate the cam 30 to the next position. As the cam 30 rotates, the protrusion 90 rotates, and the lip 101 rides along the surface of the protrusion 90 until the protrusion surface is out of contact with the lip 101 and the concave face of the protrusion 90 faces the bottom surface of the adapter lip 101 engaging the blade with the photoreceptor. The weight adapter 100, in FIG. 6, is attached to the weight by two clips 102 on either side of an opening in the weight adapter 100 that goes around the weight.

Figure 8:
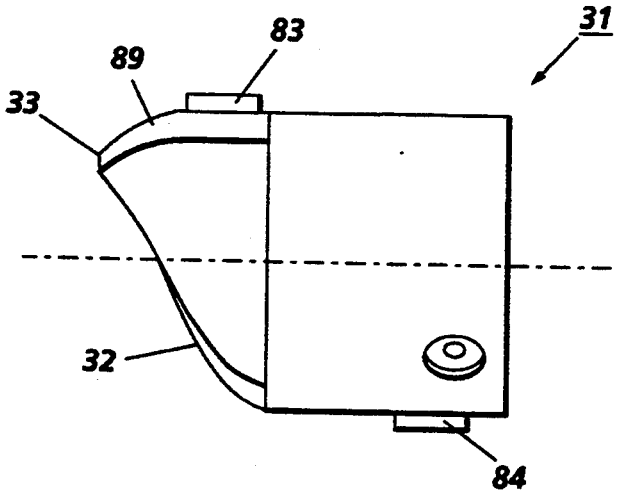
FIG. 8 is an elevational view of the alternate embodiment of the cam.
Figure 7:
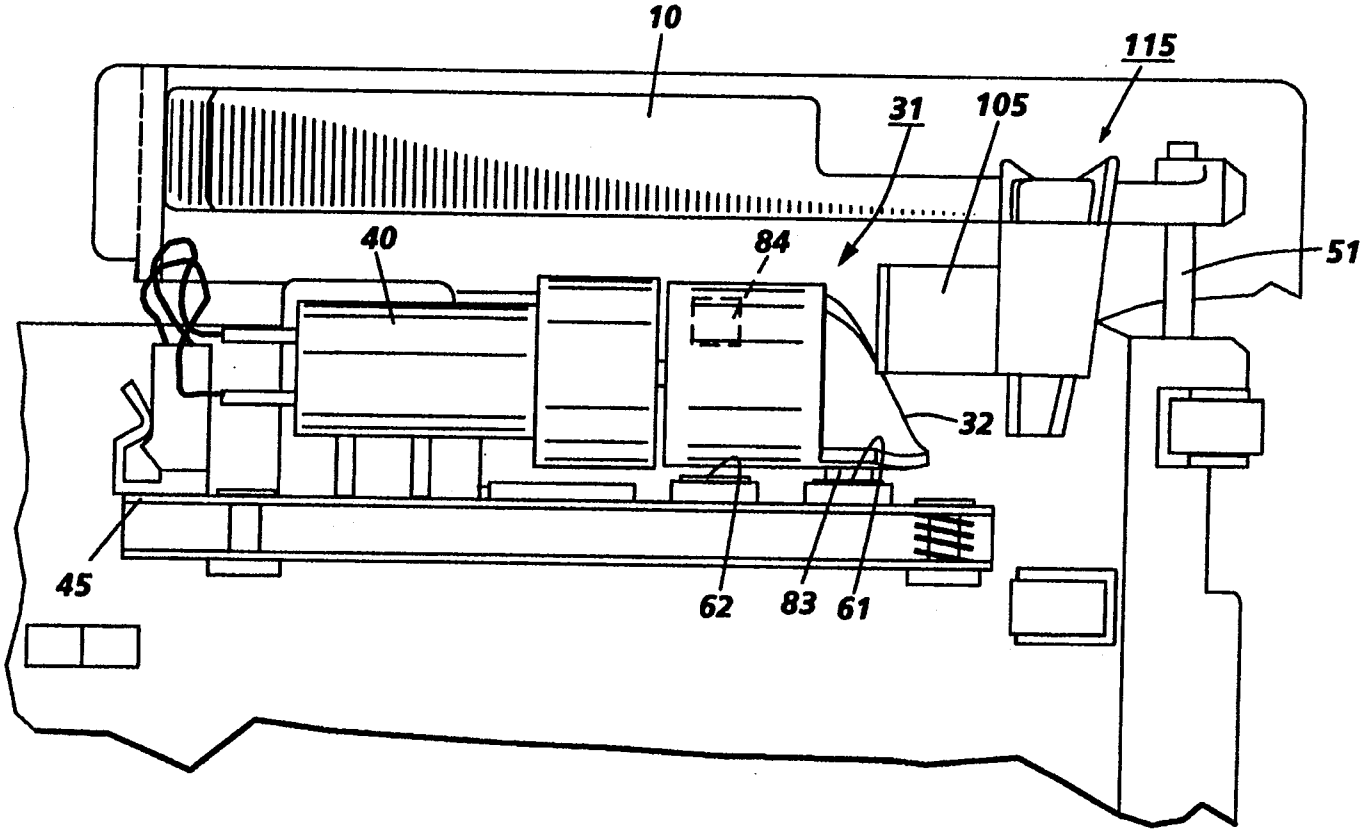
FIG. 7 is a plan view of a module containing an alternate embodiment of the present invention.

Reference is now made to FIG. 7 and FIG. 8, which disclose an alternate embodiment of the present invention. The cam 31 shows a sloping section that acts as a guide for the weight adapter 115 to gently engage the blade 50 from the photoreceptor. The weight adapter 115 is raised as the angled weight adapter lip 105 is raised upward, guided by the gradual incline of the cam slope 32, until it reaches the apex of the slope protrusion 32 of the cam 31. The apex 33 (shown in FIG. 8) contacts the front face 108 (see FIG. 9) of the lip 105. The contact of the apex 33 with the lip 105 raises the weight 10, urging the blade (not shown) out of contact with the photoreceptor (not shown). To engage the blade 50, the cam 31 rotates to the next position gently guiding the front face of the lip 108 down the declining side of the lip 105 of the protrusion slope 32 until the lip 105 is no longer in contact with the protrusion slope 32 (i.e. the concave portion of the cam 31 is facing the bottom side of the lip 105). The operation of this cam embodiment is similar to that described in FIG. 1.

With further reference to FIG. 8, the sloping protrusion 32 of the cam 31 gently guides the weight adapter 115 (shown in FIG. 9) along the flattened edge 89 of the declining side of the sloping protrusion 32 of the cam 31, reducing first copy reprint. The lobes 83, 84 contact the momentary switches 61, 62 as shown in FIG. 7, at different times. This interaction is described above with reference to FIGS. 5 and 6. Depending upon which lobe 83, 84 is in contact with it's respective switch 61, 62 (see FIG. 7) will determine whether or not the blade is engaged or disengaged.

Figure 9:
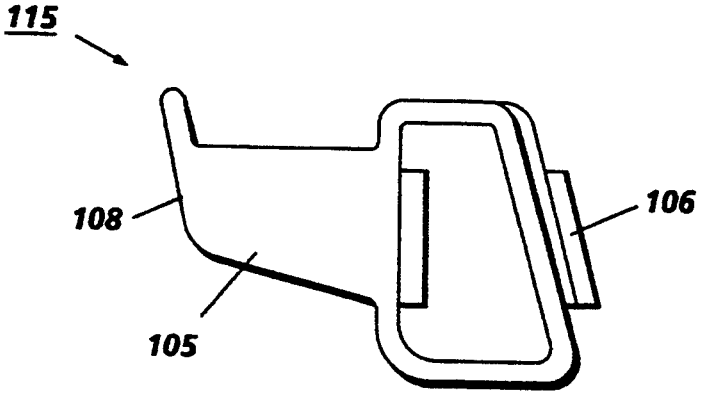
FIG. 9 is an elevational view of the alternate embodiment of the weight adapter.

Reference is made to FIG. 9 which shows an elevational view of an alternate embodiment of the weight adapter 115. The front surface 108 of the weight adapter lip 105 enables the cam protrusion slope 32 (shown in FIG. 8) to provide a gradual disengagement of the cleaning blade from the photoreceptor (i.e. imaging surface) when the weight is raised as the apex 33 and the front face 108 are placed in contact with one another. To engage the blade, the protrusion slope decline, on the opposite side of the apex 33 from the inclining slope, in the direction of rotation of the cam, provides a gradual decline along the protrusion slope 32 to a flat surface 89. The height of the front face 108 of the lip 105 is extended in this embodiment, to provide more of a front surface 108 for the cam protrusion to ride along. This increased surface is high enough to prevent an abrupt loss of contact between the front surface and the cam as the cam rotates out of contact with the lip 105. Thus the increased height of the front face 108 of the lip 105 riding along the cam slope, reduces the speed and force of the blade as it engages the photoreceptor (i.e. avoiding the "slamming" affect). This reduces the amount of excess toner that will be applied to the imaging surface upon initial start up of the machine avoiding FCR. To engage the blade with the photoreceptor, the lip 105 slides gently into position, adjacent the flat edge 89 (see FIG. 8) of the cam, with the concave portion of the cam facing the bottom surface of the lip 105 without the "slamming" affect.

With continuing reference to FIG. 9, there are clamps 106 located on either side of an opening that a portion of the weight is inserted in. These clamps 106 hold the weight adapter 115 in place on the weight 10 (see FIG. 3).

In recapitulation, the present invention prevents first copy reprint and the misalignment problem between the weight and gap by replacing the solenoid with a blade controller modified cam and weight adapter.

It is, therefore, apparent that there has been provided in accordance with the present invention, a blade controller assembly with a cam and weight adapter that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a surface, comprising:

a cleaning blade contacting the surface to remove particles therefrom;

a controller assembly for moving said cleaning blade between a first position and a second position, said controller assembly having a movable cam and said cam having a first end and a second end opposite one another, said controller assembly having a motor drivingly coupled to said second end of said cam;

a weight adapter engaging said cam, said cam being adjacent to said adapter, said cam moving out of contact with said adapter to move said cleaning means to the first position and said cam moving into contact with said adapter to move said cleaning means to the second position;

a weight coupled to said weight adapter, said weight being lowered by said adapter, said weight causing said cleaning means to move to the first position and said weight being raised by said adapter, said weight causing said cleaning blade to move to the second position;

a printed wiring board assembly located adjacent to said controller assembly, said wiring board assembly having a plurality of switches, including a first switch and a second switch, thereon; and at least two lobes on said cam, a first lobe and a second lobe, said lobes oppose one another and are adjacent to said switches, such that when one lobe of said cam is in contact with one switch on the printed wiring board assembly to activate the one switch, the other switch is out of contact with the other lobe to inactivate the other switch and, said lobes separately contacting said switches moving said cleaning blade between the first position and the second position.

2. An apparatus as recited in claim 1, wherein said weight adapter comprises a lip, said lip having a top surface and a bottom surface.

3. An apparatus as recited in claim 2, wherein said first lobe on said cam is rotated into contact with said first switch by said motor, said first lobe depressing said first switch and said second lobe is rotated into contact with said second switch by said motor, said second lobe depressing said second switch.

4. An apparatus as recited in claim 3, wherein said first end of said cam includes an arcuate protrusion having a convex surface and a concave surface opposite one another.

5. An apparatus as recited in claim 4, wherein said first switch being depressed, rotates said concave face of said arcuate protrusion until said concave surface faces said lip and said concave surface is out of contact with said lip, moving the cleaning blade to the first position.

6. An apparatus as recited in claim 4, wherein said second switch being depressed, rotates said convex surface of said arcuate protrusion into contact with said lip, said lip being guided along said convex surface, moving the cleaning blade to the second position.

7. An apparatus as recited in claim 5, wherein said first position comprises said cleaning blade being engaged to contact the surface.

8. An apparatus as recited in claim 6, wherein said second position comprises said cleaning blade being retracted from the surface.

* * * * *